US009610683B2

(12) United States Patent
Lin et al.

(10) Patent No.: US 9,610,683 B2
(45) Date of Patent: Apr. 4, 2017

(54) MARKING MACHINE FOR HULL BLOCK SECTIONS

(71) Applicant: Dalian University of Technology, Dalian (CN)

(72) Inventors: Yan Lin, Dalian (CN); Ming Chen, Dalian (CN); Yanyun Yu, Dalian (CN); Kai Li, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 146 days.

(21) Appl. No.: 14/744,188

(22) Filed: Jun. 19, 2015

(65) Prior Publication Data

US 2015/0283696 A1 Oct. 8, 2015

Related U.S. Application Data

(63) Continuation-in-part of application No. PCT/CN2013/000148, filed on Feb. 17, 2013.

(30) Foreign Application Priority Data

Dec. 21, 2012 (CN) ..... 2012 1 0558452

(51) Int. Cl.

| | |
|---|---|
| ***B25H 7/00*** | (2006.01) |
| ***B25H 7/04*** | (2006.01) |
| ***B63B 9/00*** | (2006.01) |

(52) U.S. Cl.

CPC *B25H 7/04* (2013.01); *B63B 9/00* (2013.01)

(58) Field of Classification Search

CPC ..... B25H 7/04; B63B 9/00
USPC ..... 33/18.2
See application file for complete search history.

(56) References Cited

U.S. PATENT DOCUMENTS

| | | | | |
|---|---|---|---|---|
| 6,852,989 | B2 * | 2/2005 | Kwan | G03F 7/70716 250/491.1 |
| 8,109,395 | B2 * | 2/2012 | Gaunekar | B23Q 1/012 212/324 |
| 8,973,768 | B1 * | 3/2015 | Jung | B25J 9/026 212/312 |
| 2014/0236339 | A1 * | 8/2014 | Fagan | G05B 19/182 700/160 |
| 2015/0283696 | A1 * | 10/2015 | Lin | B25H 7/04 248/122.1 |

* cited by examiner

*Primary Examiner* — Yaritza Guadalupe-McCall
(74) *Attorney, Agent, or Firm* — Matthias Scholl, PC; Matthias Scholl

(57) ABSTRACT

A marking machine for sections of vessels, including: a marking device and a gantry. The gantry includes rail wheels, horizontal beams, and upright columns. The horizontal beams include an upper beam, middle beams, and lower beams. The marking device is disposed on the upper beam of the gantry. The marking device includes a trolley and a marking arm. The trolley hangs on the upper beam. The marking arm includes a plumbing arm, a swing arm, a first universal joint, a second universal joint, a first Z-shaped steering knuckle, a second Z-shaped steering knuckle, a telescopic arm, and a penholder. The plumbing arm is fixedly connected to the lower part of the trolley. The first universal joint is disposed on the plumbing arm. The first Z-shaped steering knuckle is connected to the first universal joint.

4 Claims, 9 Drawing Sheets

MARKING MACHINE FOR HULL BLOCK SECTIONS

CROSS-REFERENCE TO RELATED APPLICATIONS

This application is a continuation-in-part of International Patent Application No. PCT/CN2013/000148 with an international filing date of Feb. 17, 2013, designating the United States, now pending, and further claims priority benefits to Chinese Patent Application No. 201210558452.2 filed Dec. 21, 2012. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18$^{th}$ Floor, Cambridge, Mass. 02142.

BACKGROUND OF THE INVENTION

Field of the Invention

The invention relates to a marking machine for sections of vessels.

Description of the Related Art

Typically, marine engineering equipment including vessels is fabricated in sections and then the sections are assembled by welding. The assembly accuracy and efficiency determine the product quality and production cycle. To improve the assembly accuracy and efficiency, prior to assembly, the sections need measuring, marking and slicing. Currently, the marking operation is mainly manually made, which occupies a large number of berths, and the manual operation has low efficiency and poor accuracy, high labor intensity, and high operational risks.

SUMMARY OF THE INVENTION

In view of the above-described problems, it is one objective of the invention to provide a marking machine for sections of vessels (including boats and ships) that features a reasonable design, compact structure, convenient assembly, disassembly and maintenance, high strength, rigidity, and reliability. The marking machine can automatically make marks on steel sections of vessels, with high accuracy and high efficiency, which is favorable to improving the manufacturing technology level and product quality.

To achieve the above objective, in accordance with one embodiment of the invention, there is provided a marking machine for sections of vessels, comprising: a marking device and a gantry. The gantry comprises rail wheels, horizontal beams, and upright columns. The horizontal beams comprise an upper beam, middle beams, and lower beams. The marking device is disposed on the upper beam of the gantry. The marking device comprises a trolley and a marking arm. The trolley hangs on the upper beam. The marking arm comprises a plumbing arm, a swing arm, a first universal joint, a second universal joint, a first Z-shaped steering knuckle, a second Z-shaped steering knuckle, a telescopic arm, and a penholder. The plumbing arm is fixedly connected to a lower part of the trolley. The first universal joint is disposed on the plumbing arm. The first Z-shaped steering knuckle is connected to the first universal joint. The first universal joint is connected to the swing arm via the first Z-shaped steering knuckle. The second universal joint is disposed on the swing arm. The second Z-shaped steering knuckle is connected to the second universal joint.

The second universal joint is connected to the telescopic arm via the second Z-shaped steering knuckle. The penholder is disposed at a front end of the telescopic arm; two troughed slideways are disposed in the upper beam, and the trolley comprises four bearing wheels adapted to rolling on the two roughed slideways. The first universal joint and the second universal joint each comprises an upper circular block and a lower circular block; a first driving motor is disposed in the upper circular block, and a second driving motor is disposed in the lower circular block. The first driving motor drives a revolving piston via a piston rod to move along flanks of the plumbing arm. The second driving motor drives an annular rack fixed on the lower circular block via a gear to rotate. The first Z-shaped steering knuckle comprises a segment gear and an eye plate. The segment gear is fixed on a convex shaft of the lower circular block; and a first motor is fixed on the eye plate to drive a small segment gear engaged with the segment gear to rotate.

In a class of this embodiment, the upright column comprises four vertical columns and four rectangular inclined columns; the vertical columns are disposed between the lower beams and the middle beams, and the rectangular inclined columns are disposed between the middle beams and the upper beam; two vertical columns, two rectangular inclined columns, one lower beam, and one middle beam constitute a side structure, and two side structures support the upper beam to form the gantry.

In a class of this embodiment, a motor, a steel cable, and a plurality of guide wheels are disposed in the upper beam, the steel cable is wound on the guide wheels, and the trolley is driven by the motor via the steel cable wound on the guide wheels.

In a class of this embodiment, a first thrust bearing is disposed in the vicinity of the piston rod, and a second thrust bearing is disposed between the upper circular block and the lower circular block.

Advantages according to embodiments of the invention are summarized as follows. The marking machine for sections of vessels comprises a marking device and a gantry. The marking device is disposed on the gantry. The marking device comprises a trolley and a marking arm capable of moving with high freedom. The gantry comprises rail wheels, horizontal beams, and upright columns. The gantry operates to support the trolley and the marking arm. The marking device operates to provide the marking arm with high accuracy and multiple freedom movement and locating. The marking device is the key element of the machine, which comprises a plumbing arm, a swing arm, universal joints, Z-shaped steering knuckles, a telescopic arm, and a penholder. The marking machine features a reasonable design, compact structure, convenient assembly, disassembly and maintenance, high strength, rigidity, and reliability. The marking machine can automatically make marks on steel sections of vessels, with high accuracy and high efficiency, which is favorable to improving the manufacturing technology level and product quality.

BRIEF DESCRIPTION OF THE DRAWINGS

The invention is described hereinbelow with reference to the accompanying drawings, in which.

Figure 1:
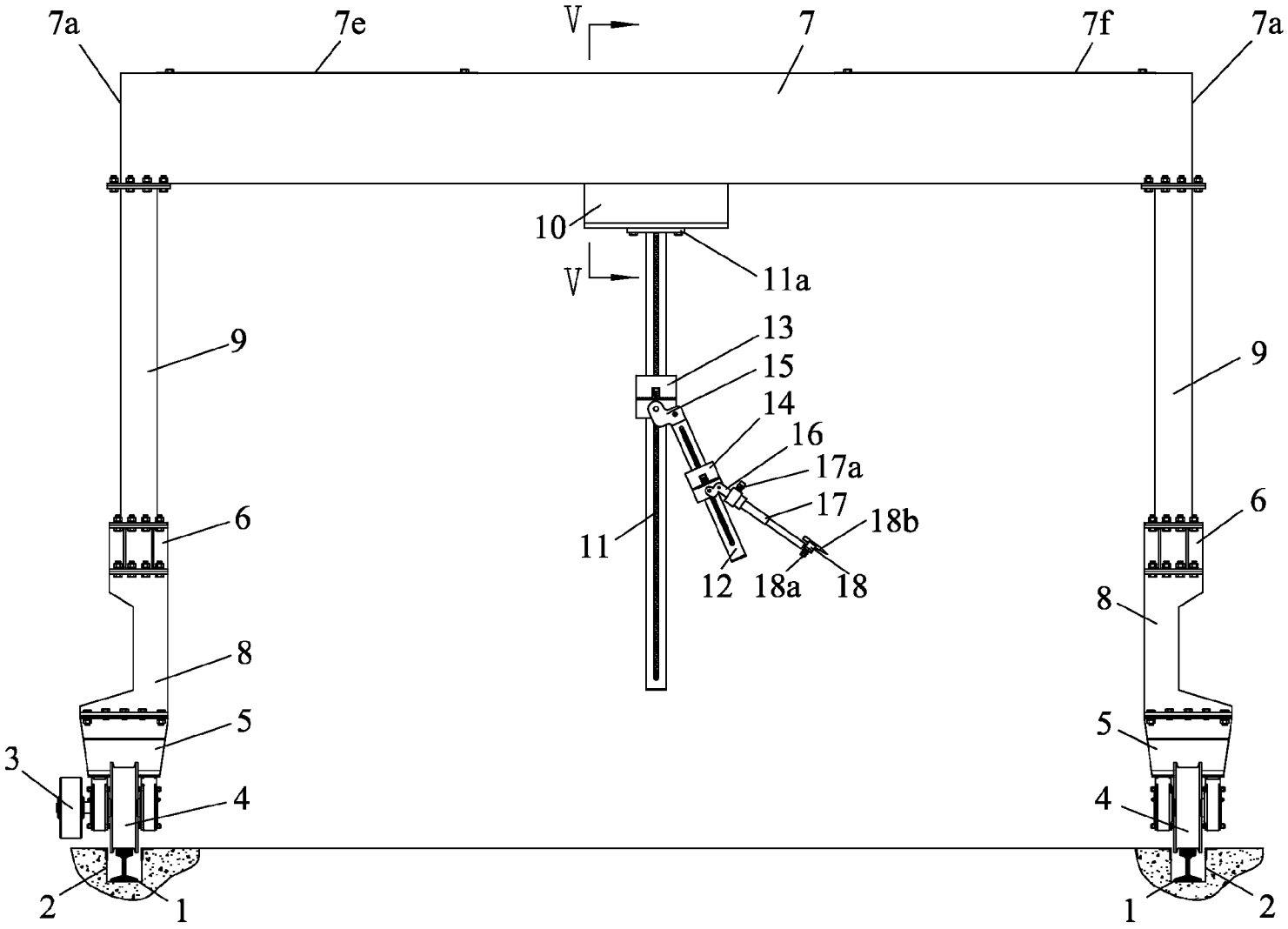
FIG. 1 is a front view of a marking machine for sections of vessels in accordance with one embodiment of the invention.

In the drawings, the following reference numbers are used: 1. Track; 2. Trench; 3. Drive gear; 4. Rail wheel; 5. Lower beam; 5*j*. Antiskid chain; 5*k*. End; 6. Middle beam; 7. Upper beam; 7*a*. End plate; 7*b*. Troughed slideway; 7*d*. Knee plate; 7*e*. Left cover plate; 7*f*. Right cover plate; 7*g*. Motor; 7*h*. Guide wheel; 7*i*. Steel cable; 8. Vertical column; 9. Rectangular inclined column; 10. Trolley; 10*a*. Base plate; 10*b*. First side plate; 10*c*. Second side plate; 10*d*. Hook; 10*e*. Bolt hole; 10*f*. Bearing wheel; 11. Plumbing arm; 11*a*. Upper flange; 11*b*. Guide groove; 11*c*. Flank; 11*d*. Circular thread seal plate; 12. Swing arm; 13. First universal joint; 14. Second universal joint; 15. First Z-shaped steering knuckle; 15*a*. Eye plate; 15*b*. Cylindrical connection piece; 15*c*. Screw nail; 15*d*. First motor; 15*e*. Small segment gear; 16. Second Z-shaped steering knuckle; 17. Telescopic arm; 17*a*. Electric push rod; 18. Penholder; 18*a*. Second motor; 18*b*. Marker pen; 19. Upper circular block; 20. Boss; 21. Lower circular block; 22. Revolving piston; 23. Guide piston ring; 24. Cylindrical driving box; 25. First driving motor; 26. Second driving motor; 27. Annular guide groove; 28. Gear; 29. First thrust bearing; 30. Piston rod; 31. Second thrust bearing; 32. Annular rack; 33. Convex shaft; 34. Segment gear.

DETAILED DESCRIPTION OF THE EMBODIMENTS

For further illustrating the invention, experiments detailing a marking machine for sections of vessels are described below. It should be noted that the following examples are intended to describe and not to limit the invention.

Figure 2:
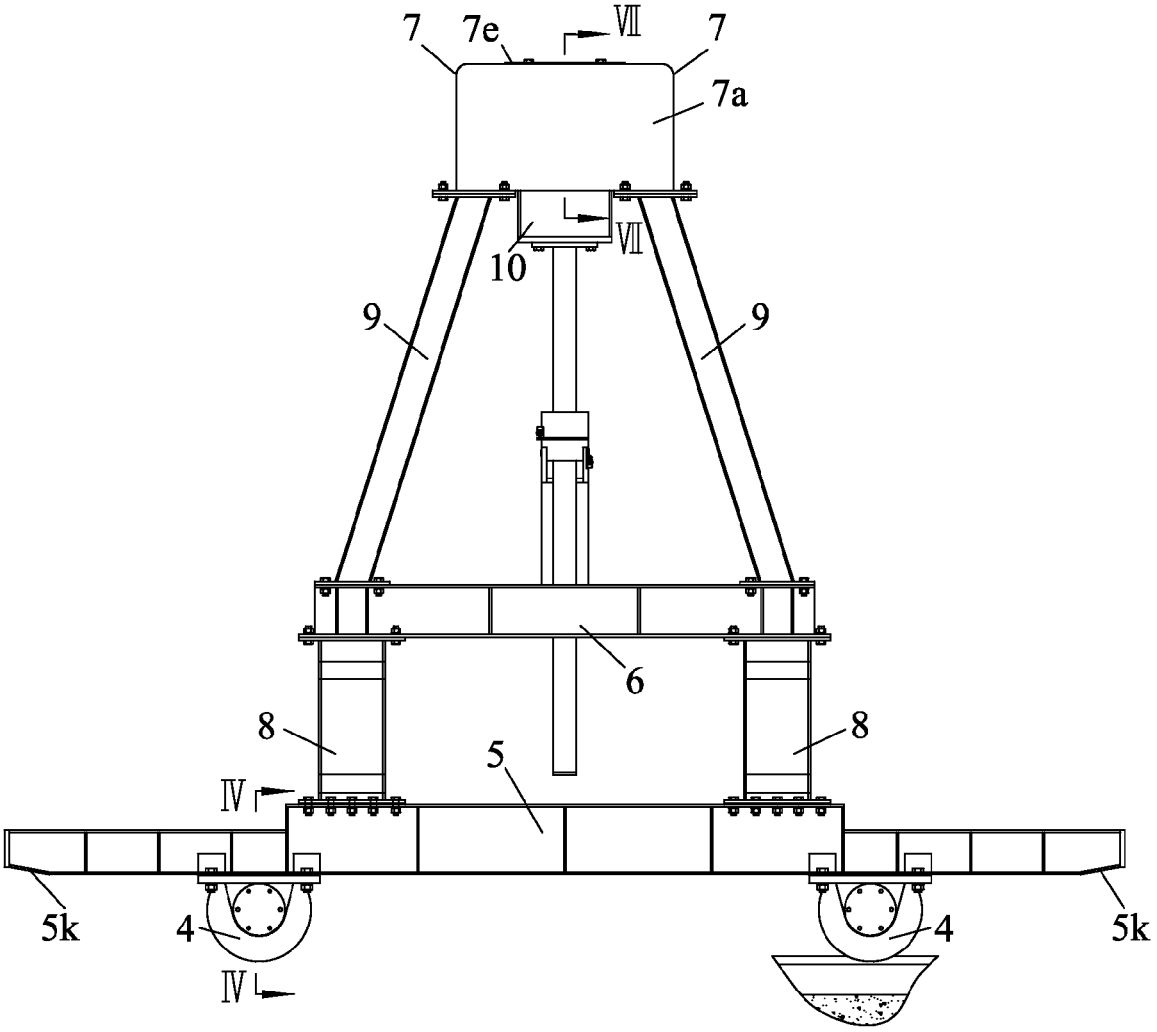
FIG. 2 is a side view of a marking machine for sections of vessels in accordance with one embodiment of the invention.
Figure 3:
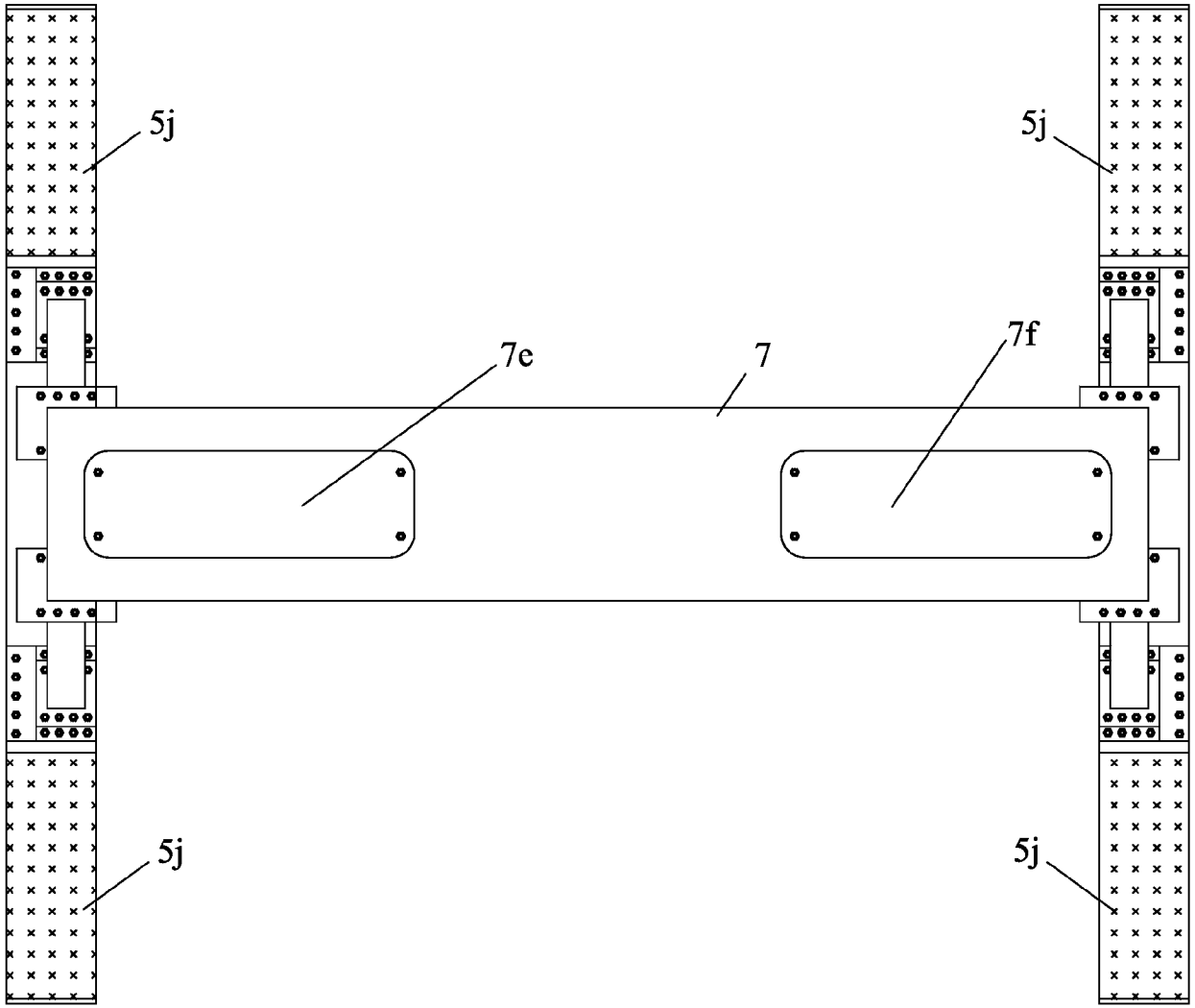
FIG. 3 is a top view of a marking machine for sections of vessels in accordance with one embodiment of the invention.

As shown in FIGS. 1-3, the invention provides a marking machine for sections of vessels which presents in the form of a gantry. The marking machine comprises a marking device and a gantry. The gantry comprises rail wheels 4, horizontal beams, and upright columns. The horizontal beams comprise an upper beam 7, middle beams, and lower beams. The marking device is disposed on the upper beam 7 of the gantry. The marking device mainly comprises a trolley 10 and a marking arm. The marking device operates to provide the marking arm with high accuracy and multiple freedom movement and locating. The gantry mainly operates to support the trolley and the marking arm, and carry controllers.

1. Track and Wheels

Figure 4:
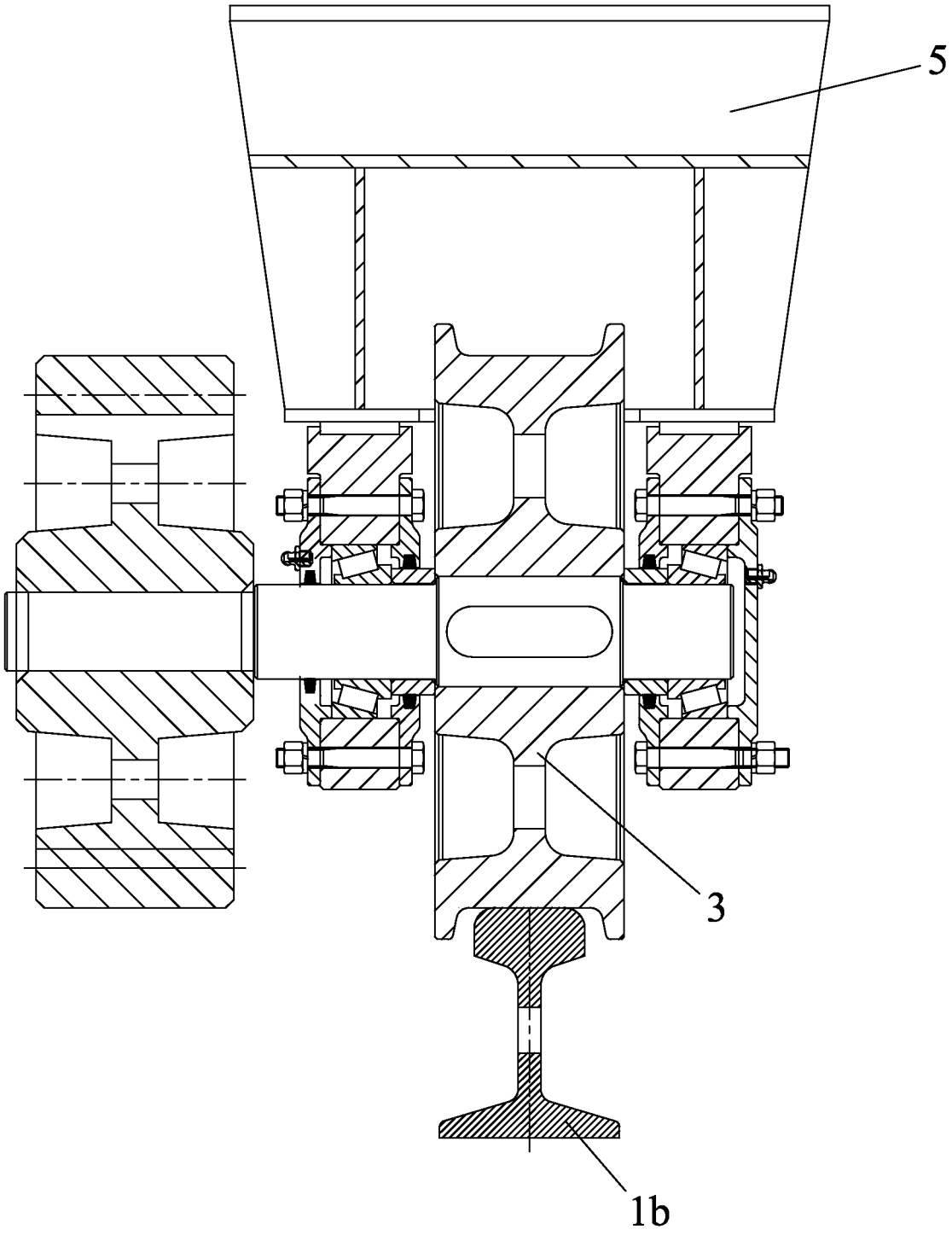
FIG. 4 is a sectional view of a connection of a track and a rail wheel in accordance with one embodiment of the invention.

Parallel tracks 1 are laid horizontally in the trench 2 and firmly bonded to the ground concrete. The upper surface of the tracks 2 is level to the ground thereby favoring the movement of the sections of ships and increasing the effective operational height. The length and space between the tracks are determined by the length and width of the sections of the ships. The bearing capacity of the ground and the straightness of the laid tracks meet the operational requirements. Four rail wheels 4 roll on the tracks. One of the four rail wheels is driven by a drive gear 3 (as shown in FIG. 4). The drive gear 3 is connected to a drive device, for example, a motor.

2. Horizontal Beams

Figure 5:
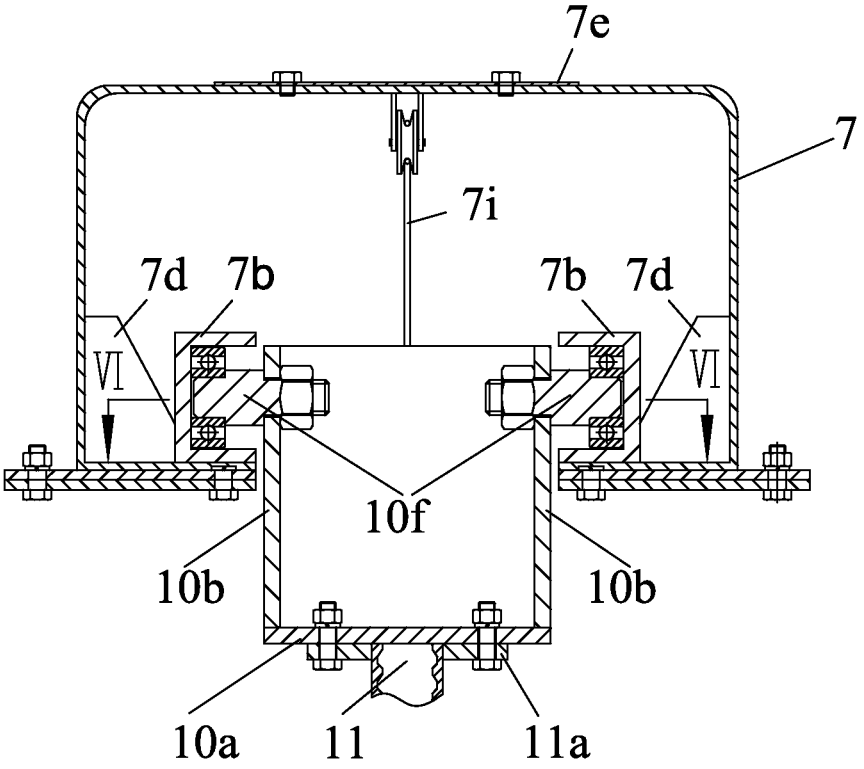
FIG. 5 is a side sectional view of a connection of an upper beam and a trolley in accordance with one embodiment of the invention.

The marking machine of the invention comprises five horizontal beams, i.e., two lower beams 5 (as shown in FIGS. 1 and 2), two middle beams 6 (as shown in FIGS. 1 and 2), and one upper beam 7 (as shown in FIG. 5).

The two lower beams 5 are disposed on the rail wheels 4. Each lower beam 5 is supported by two rail wheels 4 and with the rolling of the rail wheels 4, the gantry moves along the tracks. The width of the top panel of the lower beams 5 is larger than that of the bottom panel. The cross sectional view of the lower beams 5 is in stepped variation, and the middle section of the lower beams is higher than two ends thereof. The middle section of the lower beams supports the gantry. Antiskid chains 5*j* are disposed on the top panel at the two ends of the lower beams so as to facilitate the arrangement of controlling equipment. Two ends 5*k* of the bottom panel of the lower beams incline upwards.

Two middle beams 6 are disposed above the lower beams 5. The bottom surface of the middle beams 6 is supported by vertical columns 8, and the top surface of the middle beams supports rectangular inclined columns 9. The middle beams 6 are a transition structure. The middle beams 6 and the rectangular inclined columns 9 constitute a stable triangle structure, which provides strong support to the upper beam 7.

The upper beam 7 is supported by an intersection point of two rectangular inclined columns 9. The cross sectional view of the upper beam is a rectangular structure (as shown in FIG. 5) having a downward opening. The rectangular structure has uniform cross section. Two ends of the upper beam each are provided with an end plate 7*a*. Two troughed slideways 7*b* are symmetrically disposed at two sides of the downward opening along the length direction of the upper beam 7. The troughed slideways are welded in the upper beam and a plurality of knee plates 7*d* are welded on two outer sides of the slideways, to stabilize and strengthen the troughed slideways and the upper beam. The troughed slideways operate to guide and locate the movement of the trolley 10. Two inspection doors are disposed at the top of the upper beam, which are sealed by a left cover plate 7*e* and a right cover plate 7*f*, respectively. A motor 7*g* and four guide wheels 7*h* are disposed in the upper beam. A steel cable 7*i* is wound on the guide wheels 7*h*, and two ends of the steel cable are connected to two hooks 10*d* disposed on the trolley 10, respectively. The arrangement of the inspection doors facilitates the examination and maintenance of the troughed slideways 7*b*, the trolley 10, the motor 7*g*, the guide wheels 7*h,* and the steel cable 7*i.* The two ends of the bottom surface of the upper beam are provided with connecting plates, and the connecting plates are fixed on the end plates of the rectangular inclined columns 9 via bolts.

3. Vertical Columns

The marking machine comprises eight columns, specifically, four vertical columns 8 and four rectangular inclined columns 9. The vertical columns 8 are disposed between the lower beams 5 and the middle beams 6. The end plates are welded on two ends of the vertical column 8, and the vertical columns 8 are connected to the lower beams 5 and the middle beams 6 via the end plates and bolts.

The rectangular inclined columns 9 are disposed between the middle beams 6 and the upper beam 7. The end plates are welded on two ends of the rectangular inclined columns, and the rectangular inclined columns 9 are connected to the upper beam 7 and the middle beam 6 via the end plates and bolts.

The vertical columns 8, the rectangular inclined columns 9, the lower beam 5, and the middle beams 6 constitute stable side structures. Two stable side structures support the upper beam 7 to form a stable gantry (as shown in FIGS. 1 and 2).

Figure 6:
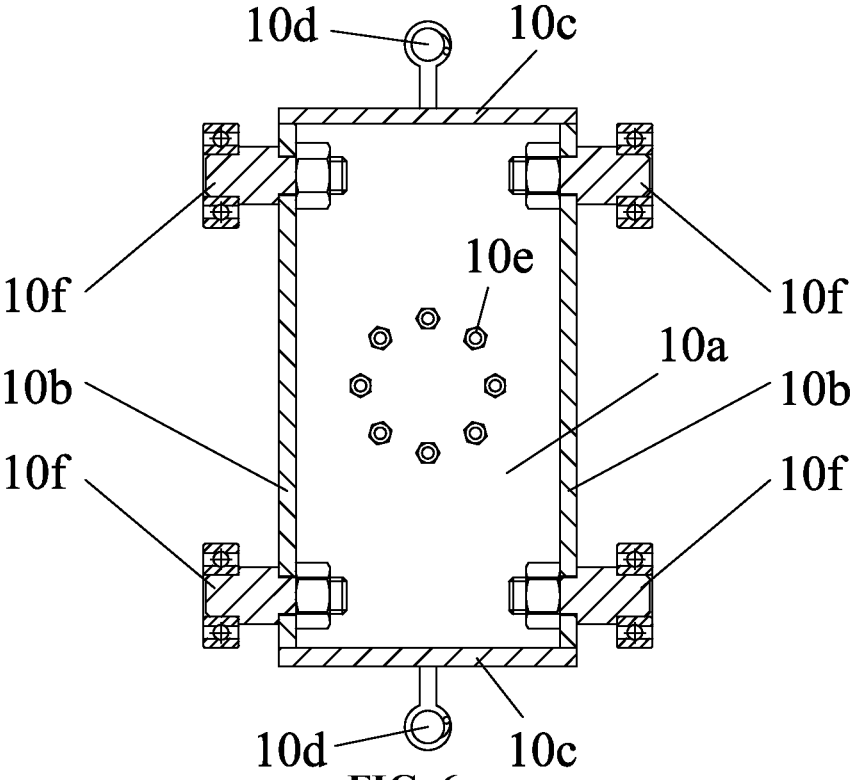
FIG. 6 is a horizontal sectional view of a trolley in accordance with one embodiment of the invention.
Figure 7:
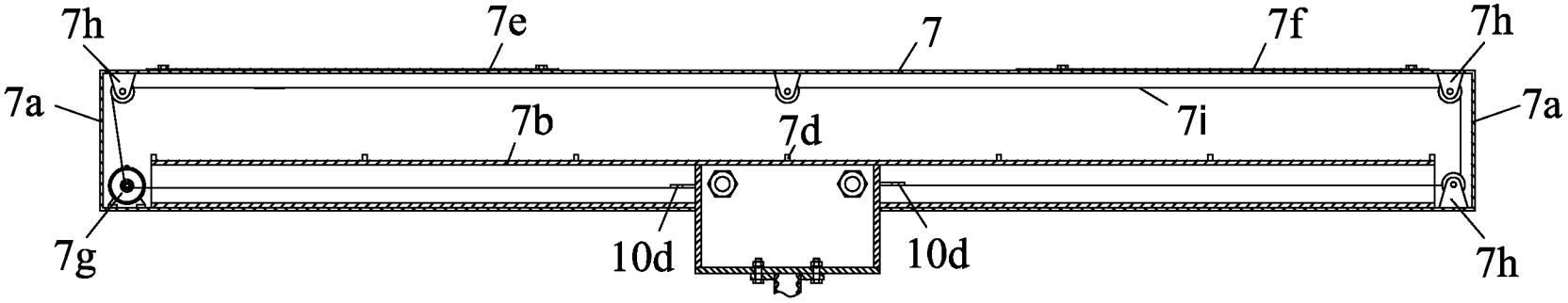
FIG. 7 is a front sectional view of a connection of an upper beam and a trolley in accordance with one embodiment of the invention.

4. Trolley 10 (as shown in FIGS. 5, 6, and 7)

The trolley 10 is a rectangular tetrahedron comprising a base plate 10*a,* two first side plates 10*b,* and two second side plates 10*c.* Eight bolt holes 10*e* are provided in the center of the base plate 10*a* to connect the marking arm below the trolley 10. Four bearing wheels 10*f* are horizontally and symmetrically disposed on the first side plates, respectively. Two hooks are respectively disposed on the outer side of the second side plates 10*c* along the central axis. Two ends of the steel cable 7*i* are connected to two hooks disposed on the trolley 10. The bearing wheels 10*f* roll in the two troughed slideways 7*b* of the upper beam 7. The motor 7*g* mounted in the upper beam 7 drives the trolley 10 to move via the steel cable 7*i.*

Figure 8:
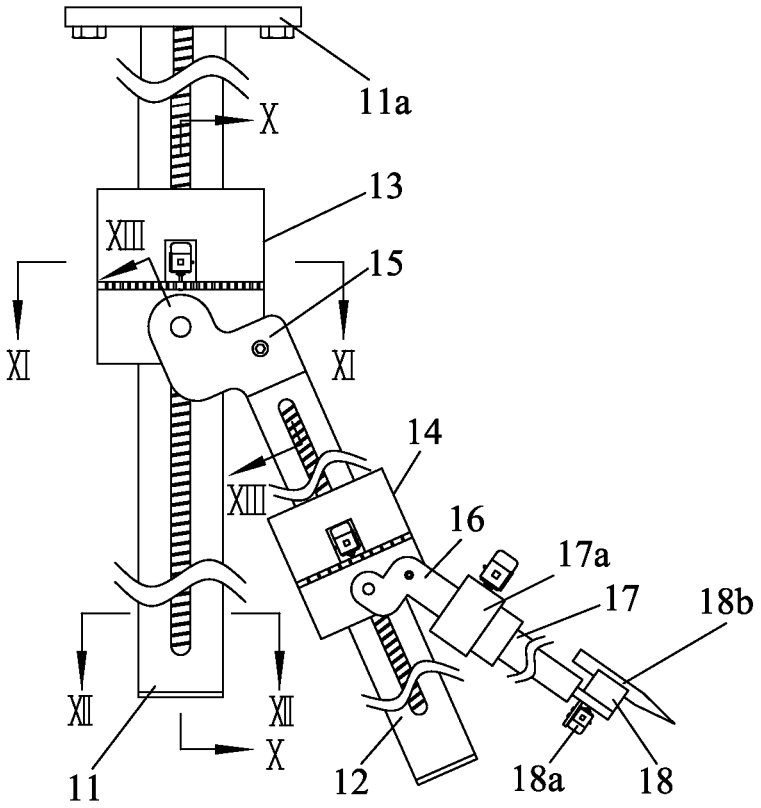
FIG. 8 is a schematic diagram of a marking arm in accordance with one embodiment of the invention.
Figure 9:
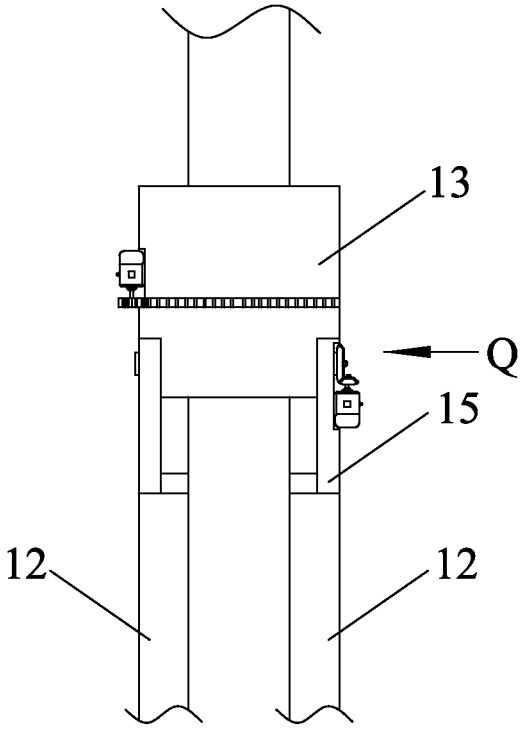
FIG. 9 is a side view of a connection of a universal joint and a Z-shaped steering knuckle in accordance with one embodiment of the invention.

5. Marking Arm (as shown in FIGS. 8 and 9)

The marking arm comprises a plumbing arm 11, a first universal joint 13, a second universal joint 14, a first Z-shaped steering knuckle 15, a second Z-shaped steering knuckle 16, a telescopic arm 17, and a penholder 18. The plumbing arm 11 is vertically disposed and the upper part thereof is connected to the trolley 10. A swing arm 12 is connected to the plumbing arm 11 via the first Z-shaped steering knuckle 15 and the first universal joint 13. The second universal joint 14 and the first Z-shaped steering knuckle 15 are disposed on the swing arm 12. The telescopic arm 17 is connected to the swing arm 12 via the second Z-shaped steering knuckle 16 and the second universal joint 14. The penholder 18 is disposed at the front end of the telescopic arm 17, and a marker pen is mounted on the penholder 18.

(1) Plumbing Arm

The plumbing arm 11 comprises an upper flange 11*a,* which is fixed on the base plate 10*a* of the trolley 7 via bolts. The swing arm 12 is connected to the plumbing arm 11 via the first Z-shaped steering knuckle 15. The structures of the swing arm 12 and the plumbing arm 11 are basically the same, which are a hollow cylinder. A guide groove 11*b* is disposed on the axial wall of the cylinder. The inner wall of the cylinder is provided with flanks 11*e* comprising self-locking angle. The bottom of the cylinder is sealed by a circular thread seal plate 11*d.* The plumbing arm 11 moves together with the trolley 10. The swing arm 12 swings or rotates around the plumbing arm 11 under the help of the first universal joint 13 and the first Z-shaped steering knuckle 15.

Figure 10:
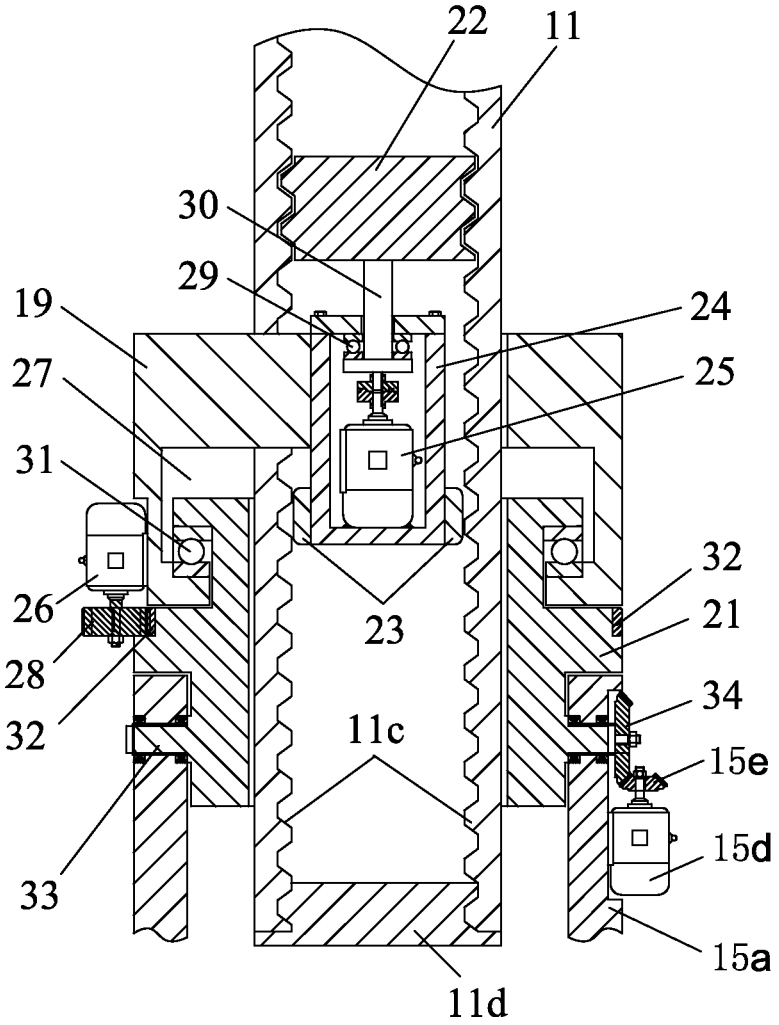
FIG. 10 is a front sectional view of a universal joint in accordance with one embodiment of the invention.
Figure 11:
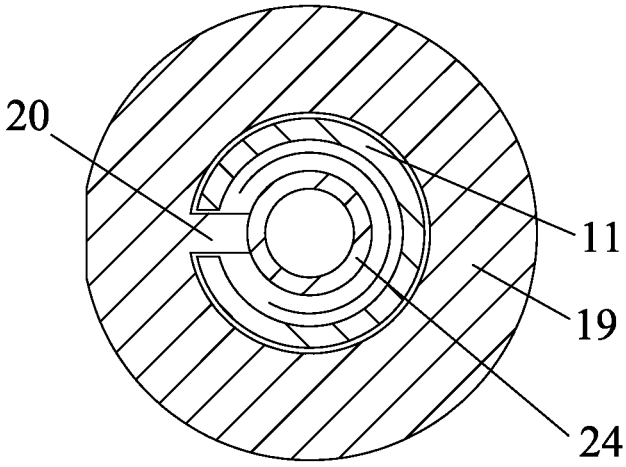
FIG. 11 is an axial sectional view of a universal joint in accordance with one embodiment of the invention.
Figure 12:
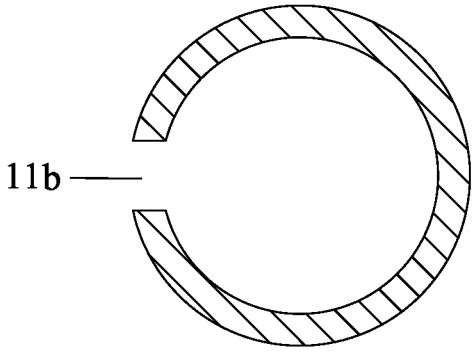
FIG. 12 is an axial sectional view of a plumbing arm in accordance with one embodiment of the invention.
Figure 13:
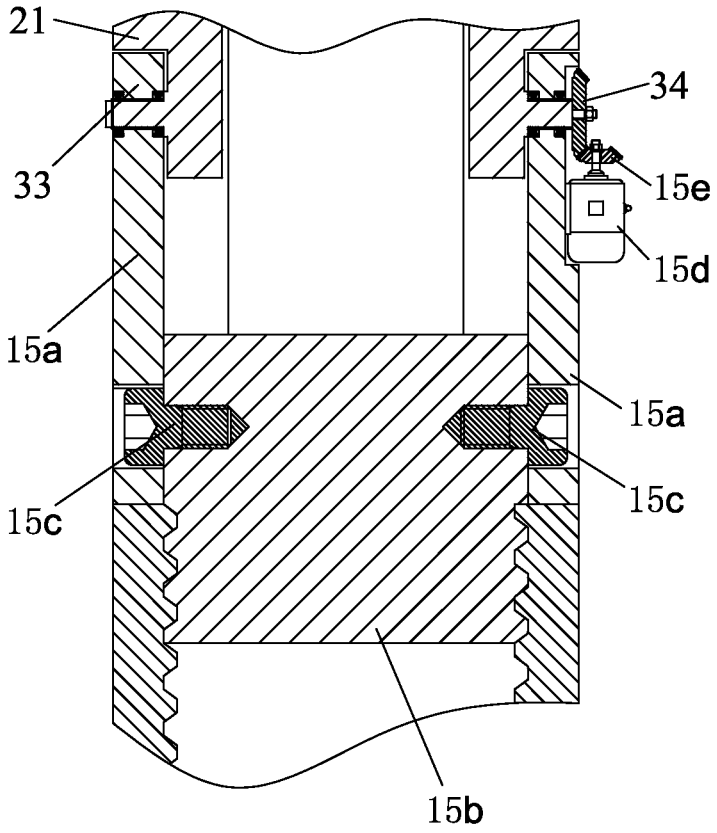
FIG. 13 is a sectional view of a universal joint in accordance with one embodiment of the invention.
Figure 14:
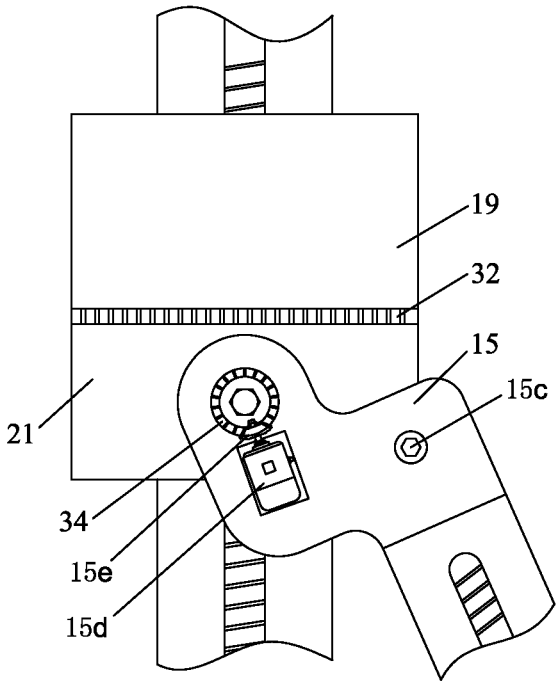
FIG. 14 is a front view of a connection of a universal joint and a Z-shaped steering knuckle in accordance with one embodiment of the invention.

(2) Universal Joint (as shown in FIGS. 10, 11, and 12)

Basically, the first universal joint 13 and the second universal joint 14 have the same structures. The first universal joint 13 is mounted on the plumbing arm 11, and the second universal joint 14 is mounted on the swing arm 12. The following takes the first universal joint 13 as an example to describe its structure in detail.

The first universal joint 13 comprises an upper circular block 19, a lower circular block 21, a revolving piston 22, a guide piston ring 23, a cylindrical driving box 24, a first driving motor 25, and a second driving motor 26. A boss 20 is provided at the inner side of the upper circular block 19 along the axial direction. The boss 20 matches the guide groove 11*b* of the plumbing arm 11. The upper circular block 19 slides along the axial direction in the plumbing arm 11. An annular guide groove 27 is disposed in the lower part of the inner side of the upper circular block 19 to connect the lower circular block 21. The outer side of the upper circular block 19 is provided with a platform, where the second driving motor 26 and a gear 28 are disposed to drive the lower circular block 21 to rotate.

The cylindrical driving box 24 is disposed in the plumbing arm 11. The first driving motor 25 is disposed in the cylindrical driving box 24, and two ends of the cylindrical driving box 24 are connected to the revolving piston 22 and the guide piston ring 23, respectively. The first driving motor 25 and a piston rod 30 cooperate to drive the revolving piston 22 to revolve along the female screw of the plumbing arm 11, whereby driving the female cylindrical driving box 24 to move axially in the plumbing arm 11. The cylindrical driving box 24 is connected to the boss 20 of the upper circular block 19 via the guide groove 11*b* of the plumbing arm 11.

Both the revolving piston 22 and the guide piston ring 23 are disposed in the plumbing arm 11. The outer side of the revolving piston 22 is provided with screw threads which match the flanks 11*e* at the inner wall of the plumbing arm 11. The revolving piston 22 is connected to the first driving motor 25 in the cylindrical driving box 24 via the piston rod 30.

A first thrust bearing 29 is disposed in the vicinity of the piston rod, and a second thrust bearing 31 is disposed between the upper circular block and the lower circular block. The upper part of the lower circular block 21 is an annular groove which matches the annular guide groove 27 of the upper circular block 19 and is supported by the second thrust bearing 31, so that the upper circular block 19 and the lower circular block 21 are combined and move along the axial direction. An annular rack 32 is mounted at the outer side of the lower circular block. The second driving motor 26 and a gear 28 disposed on the platform of the upper circular block 19 drive the annular rack 32 so that the lower circular block 21 can move along the axial direction relative to the upper circular block 21. Convex shafts 33 are disposed at the lower part of the lower circular block 21. Eye plates 15*a* of the first Z-shaped steering knuckle 15 sleeve the convex shafts 33. A segment gear 34 is disposed at one end of the convex shaft 33.

A cylindrical connection piece 15*b* is disposed at the lower part of the first Z-shaped steering knuckle 15. One end of the cylindrical surface of the first Z-shaped steering knuckle 15 is provided with screw threads, the other end has no screw threads. The end without screw threads is connected to the lower part of the first Z-shaped steering knuckle 15, which are fixed using screw nails 15*c*. The end having screw threads is in rotary connection to the swing arm 12 or the telescopic arm 17.

The outer side of the eye plate of the lower circular block 21 is provided with a step for mounting a first motor 15*d*. The first motor 15*d* drives the segment gear 34 disposed at the end of the convex shaft 33 via a small segment gear 15*e*, so that the first Z-shaped steering knuckle 15 can swing around the convex shaft 33 of the lower circular block 21.

One end of the telescopic arm 17 is connected to the second Z-shaped steering knuckle 16, and the other end is connected to the penholder 18. The arm length of the telescopic arm 17 is adjusted by an electric push rod 17*a*.

The penholder 18 is disposed at the front end of the telescopic arm 17. The angle of the marker pen 18*b* is adjusted by a gear mechanism driven by a second motor 18*a*.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A marking machine for sections of vessels, the machine comprising: a marking device and a gantry; the gantry comprising rail wheels, horizontal beams, and upright columns; the horizontal beams comprising an upper beam, middle beams, and lower beams;

wherein the marking device is disposed on the upper beam of the gantry, and comprises a trolley and a marking arm;

the trolley hangs on the upper beam;

the marking arm comprises a plumbing arm, a swing arm, a first universal joint, a second universal joint, a first Z-shaped steering knuckle, a second Z-shaped steering knuckle, a telescopic arm, and a penholder;

the plumbing arm is fixedly connected to a lower part of the trolley;

the first universal joint is disposed on the plumbing arm; the first Z-shaped steering knuckle is connected to the first universal joint; the first universal joint is connected to the swing arm via the first Z-shaped steering knuckle;

the second universal joint is disposed on the swing arm; the second Z-shaped steering knuckle is connected to the second universal joint; the second universal joint is connected to the telescopic arm via the second Z-shaped steering knuckle;

the penholder is disposed at a front end of the telescopic arm; two troughed slideways are disposed in the upper beam, and the trolley comprises four bearing wheels adapted to rolling on the two roughed slideways;

the first universal joint and the second universal joint each comprises an upper circular block and a lower circular block; a first driving motor is disposed in the upper circular block, and a second driving motor is disposed in the lower circular block;

the first driving motor drives a revolving piston via a piston rod to move along flanks of the plumbing arm; the second driving motor drives an annular rack fixed on the lower circular block via a gear to rotate; and the first Z-shaped steering knuckle comprises a segment gear and an eye plate; the segment gear is fixed on a convex shaft of the lower circular block; and a first motor is fixed on the eye plate to drive a small segment gear engaged with the segment gear to rotate.

2. The machine of claim 1, wherein the upright column comprises four vertical columns and four rectangular inclined columns;

the vertical columns are disposed between the lower beams and the middle beams, and the rectangular inclined columns are disposed between the middle beams and the upper beam; and two vertical columns, two rectangular inclined columns, one lower beam, and one middle beam constitute a side structure, and two side structures support the upper beam to form the gantry.

3. The machine of claim 1, wherein a motor, a steel cable, and a plurality of guide wheels are disposed in the upper beam, the steel cable is wound on the guide wheels, and the trolley is driven by the motor via the steel cable wound on the guide wheels.

4. The machine of claim 1, wherein a first thrust bearing is disposed in the vicinity of the piston rod, and a second thrust bearing is disposed between the upper circular block and the lower circular block.

* * * * *